US008786496B2

(12) United States Patent
Rida et al.

(10) Patent No.: US 8,786,496 B2
(45) Date of Patent: Jul. 22, 2014

(54) THREE-DIMENSIONAL ARRAY ANTENNA ON A SUBSTRATE WITH ENHANCED BACKLOBE SUPPRESSION FOR MM-WAVE AUTOMOTIVE APPLICATIONS

(75) Inventors: Amin Rida, Atlanta, GA (US); Li Yang, Allen, TX (US); Alexandros Margomenos, Pasadena, CA (US); Manos Tentzeris, Atlanta, GA (US)

(73) Assignees: Toyota Motor Engineering & Manufacturing North America, Inc., Erlanger, KY (US); Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 12/845,003

(22) Filed: Jul. 28, 2010

(65) Prior Publication Data

US 2012/0026043 A1 Feb. 2, 2012

(51) Int. Cl.

| | |
|---|---|
| ***H01Q 1/38*** | (2006.01) |
| ***H01Q 1/32*** | (2006.01) |
| ***H01Q 21/06*** | (2006.01) |

(52) U.S. Cl.

CPC ..... *H01Q 1/3233* (2013.01); *H01Q 21/065* (2013.01)

USPC ..... 343/700 MS

(58) Field of Classification Search

CPC ..... H01Q 1/3233; H01Q 21/065

USPC ..... 343/700 MS, 834

See application file for complete search history.

(56) References Cited

U.S. PATENT DOCUMENTS

| | | | |
|---|---|---|---|
| 3,093,805 | A | 6/1963 | Osifchin et al. |
| 3,686,596 | A | 8/1972 | Albee |
| 4,259,743 | A | 3/1981 | Kaneko et al. |
| 4,494,083 | A | 1/1985 | Josefsson et al. |
| 4,513,266 | A | 4/1985 | Ishihara |
| 4,623,894 | A | 11/1986 | Lee et al. |
| 4,731,611 | A | 3/1988 | Muller et al. |
| 4,786,913 | A | 11/1988 | Barendregt et al. |
| 5,008,678 | A | 4/1991 | Herman |
| 5,111,210 | A | 5/1992 | Morse |

(Continued)

FOREIGN PATENT DOCUMENTS

| | | |
|---|---|---|
| CN | 101145627 | 3/2008 |
| EP | 1324423 | 7/2003 |

(Continued)

OTHER PUBLICATIONS

Targonski, S.D.; Waterhouse, R.B.; , "Reflector elements for aperture and aperture coupled microstrip antennas," Antennas and Propagation Society International Symposium, 1997. IEEE., 1997 Digest , vol. 3, No., pp. 1840-1843 vol. 3, Jul. 13-18, 1997.*

(Continued)

*Primary Examiner* — Robert Karacsony

(74) *Attorney, Agent, or Firm* — Snell & Wilmer LLP

(57) ABSTRACT

A multilayer antenna including a first microstrip patch positioned along a first plane, a second microstrip patch positioned along a second plane that is substantially parallel to the first plane, and a ground plane having a slot formed therein. The multilayer antenna also includes a microstrip feeding line for propagating signals through the slot in the ground plane and to the second microstrip patch and a backlobe suppression reflector for receiving some of the signals and reflecting the signals to the slot in the ground plane.

9 Claims, 8 Drawing Sheets

(56) References Cited

U.S. PATENT DOCUMENTS 5,115,245 A 5/1992 Wen et al.
5,124,713 A 6/1992 Mayes et al.
5,153,600 A 10/1992 Metzler et al.
5,220,335 A 6/1993 Huang
5,262,783 A 11/1993 Philpott et al.
5,307,075 A 4/1994 Huynh
5,376,902 A 12/1994 Bockelman et al.
5,436,453 A 7/1995 Chang et al.
5,481,268 A 1/1996 Higgins
5,485,167 A 1/1996 Wong et al.
5,495,262 A 2/1996 Klebe
5,512,901 A 4/1996 Chen et al.
5,554,865 A 9/1996 Larson
5,561,405 A 10/1996 Hoffmeister et al.
5,583,511 A 12/1996 Hulderman
5,633,615 A 5/1997 Quan
5,724,042 A 3/1998 Komatsu et al.
5,767,009 A 6/1998 Yoshida et al.
5,815,112 A 9/1998 Sasaki et al.
5,821,625 A 10/1998 Yoshida et al.
5,867,120 A 2/1999 Ishikawa et al.
5,877,726 A 3/1999 Kudoh et al.
5,886,671 A 3/1999 Riemer et al.
5,909,191 A 6/1999 Hirshfield et al.
5,923,290 A * 7/1999 Mikami et al. ..... 342/374
5,929,802 A 7/1999 Russell et al.
5,933,109 A 8/1999 Tohya et al.
5,943,005 A 8/1999 Tanizaki et al.
5,952,971 A 9/1999 Strickland
5,977,915 A 11/1999 Bergstedt et al.
5,994,766 A 11/1999 Shenoy et al.
5,999,092 A 12/1999 Smith et al.
6,008,750 A 12/1999 Cottle et al.
6,034,641 A 3/2000 Kudoh et al.
6,037,911 A 3/2000 Brankovic et al.
6,040,524 A 3/2000 Kobayashi et al.
6,043,772 A 3/2000 Voigtlaender et al.
6,091,365 A 7/2000 Derneryd et al.
6,107,578 A 8/2000 Hashim
6,107,956 A 8/2000 Russell et al.
6,114,985 A 9/2000 Russell et al.
6,130,640 A 10/2000 Uematsu et al.
6,137,434 A 10/2000 Tohya et al.
6,191,740 B1 2/2001 Kates et al.
6,232,849 B1 5/2001 Flynn et al.
6,249,242 B1 6/2001 Sekine et al.
6,278,400 B1 8/2001 Cassen et al.
6,281,843 B1 8/2001 Evtioushkine et al.
6,329,649 B1 12/2001 Jack et al.
6,359,588 B1 3/2002 Kuntzsch
6,388,206 B2 5/2002 Dove et al.
6,452,549 B1 9/2002 Lo
6,483,481 B1 11/2002 Sievenpiper et al.
6,483,714 B1 11/2002 Kabumoto et al.
6,501,415 B1 12/2002 Viana et al.
6,577,269 B2 6/2003 Woodington et al.
6,583,753 B1 6/2003 Reed
6,624,786 B2 9/2003 Boyle
6,628,230 B2 9/2003 Mikami et al.
6,639,558 B2 10/2003 Kellerman et al.
6,642,819 B1 11/2003 Jain et al.
6,642,908 B2 11/2003 Pleva et al.
6,657,518 B1 12/2003 Weller et al.
6,683,510 B1 1/2004 Padilla
6,686,867 B1 2/2004 Lissel et al.
6,703,965 B1 3/2004 Ming et al.
6,717,544 B2 4/2004 Nagasaku et al.
6,727,853 B2 4/2004 Sasada et al.
6,756,936 B1 6/2004 Wu
6,771,221 B2 8/2004 Rawnick et al.
6,784,828 B2 8/2004 Delcheccolo et al.
6,794,961 B2 9/2004 Nagaishi et al.
6,795,021 B2 9/2004 Ngai et al.
6,806,831 B2 10/2004 Johansson et al.
6,828,556 B2 12/2004 Pobanz et al.
6,833,806 B2 12/2004 Nagasaku et al.
6,842,140 B2 1/2005 Killen et al.
6,853,329 B2 2/2005 Shinoda et al.
6,864,831 B2 3/2005 Woodington et al.
6,873,250 B2 3/2005 Viana et al.
6,897,819 B2 5/2005 Henderson et al.
6,909,405 B2 6/2005 Kondo
6,930,639 B2 8/2005 Bauregger et al.
6,933,881 B2 8/2005 Shinoda et al.
6,940,547 B1 9/2005 Mine
6,946,995 B2 9/2005 Choi et al.
6,987,307 B2 1/2006 White et al.
6,992,629 B2 1/2006 Kerner et al.
7,009,551 B1 3/2006 Sapletal
7,015,860 B2 3/2006 Alsliety
7,019,697 B2 3/2006 du Toit
7,030,712 B2 4/2006 Brunette et al.
7,034,753 B1 4/2006 Elsallal et al.
7,071,889 B2 7/2006 McKinzie, III et al.
7,081,847 B2 7/2006 Ziller et al.
7,098,842 B2 8/2006 Nakazawa et al.
7,102,571 B2 9/2006 McCarrick
7,106,264 B2 9/2006 Lee et al.
7,109,922 B2 9/2006 Shmuel
7,109,926 B2 9/2006 du Toit
7,154,356 B2 12/2006 Brunette et al.
7,154,432 B2 12/2006 Nagasaku et al.
7,170,361 B1 1/2007 Farnworth
7,177,549 B2 2/2007 Matsushima et al.
7,187,334 B2 3/2007 Franson et al.
7,193,562 B2 3/2007 Shtrom et al.
7,215,284 B2 5/2007 Collinson
7,236,130 B2 6/2007 Voigtlaender
7,239,779 B2 7/2007 Little
7,268,732 B2 9/2007 Gotzig et al.
7,292,125 B2 11/2007 Mansour et al.
7,298,234 B2 11/2007 Dutta
7,307,581 B2 12/2007 Sasada
7,310,061 B2 12/2007 Nagasaku et al.
7,331,723 B2 2/2008 Yoon et al.
7,336,221 B2 2/2008 Matsuo et al.
7,355,547 B2 4/2008 Nakazawa et al.
7,358,497 B1 4/2008 Boreman et al.
7,362,259 B2 4/2008 Gottwald
7,388,279 B2 6/2008 Fjelstad et al.
7,408,500 B2 8/2008 Shinoda et al.
7,411,542 B2 8/2008 O'Boyle
7,414,569 B2 8/2008 De Mersseman
7,436,363 B1 10/2008 Klein et al.
7,446,696 B2 11/2008 Kondo et al.
7,456,790 B2 11/2008 Isono et al.
7,463,122 B2 12/2008 Kushta et al.
7,489,280 B2 2/2009 Aminzadeh et al.
7,528,780 B2 5/2009 Thiam et al.
7,532,153 B2 5/2009 Nagasaku et al.
7,586,450 B2 9/2009 Muller
7,603,097 B2 10/2009 Leblanc et al.
7,639,173 B1 12/2009 Wang et al.
7,733,265 B2 6/2010 Margomenos et al.
7,830,301 B2 11/2010 Margomenos
7,881,689 B2 2/2011 Leblanc et al.
8,022,861 B2 9/2011 Margomenos
8,384,611 B2 2/2013 Asakura et al.
2002/0047802 A1 4/2002 Voipio
2002/0158305 A1 10/2002 Dalmia et al.
2003/0016162 A1 1/2003 Sasada et al.
2003/0034916 A1 2/2003 Kwon et al.
2003/0036349 A1 2/2003 Liu et al.
2004/0028888 A1 2/2004 Lee et al.
2004/0075604 A1 4/2004 Nakazawa et al.
2005/0109453 A1 5/2005 Jacobson et al.
2005/0156693 A1 7/2005 Dove et al.
2005/0248418 A1 11/2005 Govind et al.
2006/0044189 A1 3/2006 Livingston et al.
2006/0146484 A1 7/2006 Kim et al.
2006/0152406 A1 7/2006 Leblanc et al.
2006/0158378 A1 7/2006 Pons et al.
2006/0250298 A1 11/2006 Nakazawa et al.
2006/0267830 A1 11/2006 O'Boyle

(56) References Cited

U.S. PATENT DOCUMENTS

| | | | | |
|---|---|---|---|---|
| 2006/0290564 | A1 | 12/2006 | Sasada et al. | |
| 2007/0026567 | A1 | 2/2007 | Beer et al. | |
| 2007/0052503 | A1 | 3/2007 | Quach et al. | |
| 2007/0085108 | A1 | 4/2007 | White et al. | |
| 2007/0131452 | A1 | 6/2007 | Gilliland | |
| 2007/0230149 | A1 | 10/2007 | Bibee | |
| 2007/0279287 | A1 | 12/2007 | Castaneda et al. | |
| 2007/0285314 | A1 | 12/2007 | Mortazawi et al. | |
| 2008/0030416 | A1 | 2/2008 | Lee et al. | |
| 2008/0048800 | A1 | 2/2008 | Dutta | |
| 2008/0061900 | A1 | 3/2008 | Park et al. | |
| 2008/0068270 | A1 | 3/2008 | Thiam et al. | |
| 2008/0074338 | A1 | 3/2008 | Vacanti | |
| 2008/0150821 | A1 | 6/2008 | Koch et al. | |
| 2008/0169992 | A1 | 7/2008 | Ortiz et al. | |
| 2009/0000804 | A1 | 1/2009 | Kobayashi et al. | |
| 2009/0015483 | A1* | 1/2009 | Liu | 343/700 MS |
| 2009/0058731 | A1 | 3/2009 | Geary et al. | |
| 2009/0066593 | A1 | 3/2009 | Jared et al. | |
| 2009/0102723 | A1 | 4/2009 | Mateychuk et al. | |
| 2009/0251356 | A1* | 10/2009 | Margomenos | 342/70 |
| 2009/0251357 | A1 | 10/2009 | Margomenos | |
| 2009/0251362 | A1 | 10/2009 | Margomenos et al. | |
| 2010/0073238 | A1* | 3/2010 | Jun et al. | 343/700 MS |
| 2010/0182103 | A1 | 7/2010 | Margomenos | |
| 2010/0182107 | A1 | 7/2010 | Margomenos | |
| 2010/0327068 | A1* | 12/2010 | Chen et al. | 235/492 |

FOREIGN PATENT DOCUMENTS

| | | |
|---|---|---|
| JP | 04-286204 | 10/1992 |
| JP | 6-224629 | 8/1994 |
| JP | 8186437 | 7/1996 |
| JP | 11-088038 | 3/1999 |
| JP | 11186837 | 7/1999 |
| JP | 2001-077608 | 3/2001 |
| JP | 2001-189623 | 7/2001 |
| JP | 2002-506592 | 2/2002 |
| JP | 2007-194915 | 8/2007 |
| JP | 2008-048090 | 2/2008 |
| KR | 777967 | 11/2007 |
| WO | WO 2007149746 | 12/2007 |
| WO | WO 2008148569 | 12/2008 |

OTHER PUBLICATIONS

K. Schuler et al., "Innovative Material Modulation for Multilayer LTCC Antenna at 76.5 GHz in Radar and Communication Applications"; Proceedings of the 33rd European Microwave Conference, Munich Germany 2003; pp. 707-710; printed in the year 2003.

Walden et al., "A European Low Cost MMIC Based Millimetre-Wave Radar Module for Automotive Applications", 4 pages.

Chouvaev et al., "Application of a Substrate-Lens Antenna Concept and SiGe Component Development for Cost-Efficient Automotive Radar", *Sweedish National Testing and Research Institute, 34th European Microwave Conference*, Amsterdam, pp. 1417-1420, 2004.

"Advanced RF Frontend Technology Using Micromachined SiGe", *Information Society Technologies IST Program*, 38 pages.

Lee et al., "Characteristic of the Coplanar Waveguide to Microstrip Right-Angled Transition", 3 pages.

Suntives et al., "Design and Characterization of the EBG Waveguide-Based Interconnects", *IEEE Transactions on Advanced Packaging*, vol. 30, No. 2, pp. 163-170, May 2007.

Gedney et al., "Simulation and Performance of Passive Millimeter Wave Coplanar Waveguide Circuit Devices", *1997 Wireless Communications Conference*, pp. 27-31, May 1997.

Weller, Thomas M., "Three-Dimensional High-Frequency Distribution Networks—Part I: Optimization of CPW Discontinuities", *IEEE Transactions on Microwave Theory and Techniques*, vol. 48, No. 10, pp. 1635-1642, Oct. 2000.

Omar et al., "Effects of Air-Bridges and Mitering on Coplanar Waveguide 90° Bends: Theory and Experiment", *1993 IEEE MTT-S Digest*, pp. 823-826, 1993.

Watson et al., "Design and Optimization of CPW Circuits Using EM-ANN Models for CPW Components", *IEEE Transactions on Microwave Theory and Techniques*, vol. 45, No. 12, pp. 2515-2523, Dec. 1997.

Vetharatnam et al., "Combined Feed Network for a Shared-Aperture Dual-Band Dual-Polarized Array", *IEEE Antennas and Wireless Propagation Letters*, vol. 4, pp. 297-299, 2005.

Pozar et al., "Shared-Aperture Dual Band Dual-Polarized Microstrip Array", *IEEE Transactions on Antennas and Propagation*, vol. 49, No. 2, pp. 150-157, Feb. 2001.

Leong et al. "Coupling Suppression in Microstrip Lines using a Bi-Periodically Perforated Ground Plane", *IEEE Microwave and Wireless Components Letters*, vol. 12, No. 5, pp. 169-171, May 2002.

Iizuka et al., "Millimeter-Wave Microstrip Array Antenna for Automotive Radars", *IEEE Transactions for Communications*, vol. E86-B, No. 9, pp. 2728-2738, Sep. 2003.

Margomenos et al., "Isolation in Three-Dimensional Integrated Circuits", *IEEE Transactions on Microwave Theory and Techniques*, vol. 51, issue 1, pp. 25-32, Jan. 2003.

Ponchak et al., "Characterization of the Coupling Between Adjacent Finite Ground Coplanar (FGC) wageguides", *Int. J. Microcircuits Electron. Packag.*, vol. 20, No. 4, pp. 587-592, Nov. 1997.

Ponchak et al., "Coupling Between Microstrip Lines With Finite Width Groundh Plane Embedded in Thin-Film Circuits", *IEEE Transaction on Advanced Packaging*, vol. 28, No. 2, pp. 320-327, May 2005.

Ponchak et al., "The Use of Metal Filled Via Holes for Improving Isolation in LTCC RF and Wireless Multichip Packages", *IEEE Transactions on Advanced Packaging*, vol. 23, No. 1, pp. 88-99, Feb. 2000.

Papapolymerou et al., "Crosstalk Between Finite Ground Coplanar Waveguides Over Polyimide Layers for 3-D MMICs on Si Substrates", IEEE Transactions on Microwave Theory and Techniques, vol. 52, No. 4, pp. 1292-1301, Apr. 2004.

Mbairi et al., "On the Problem of Using Guard Traces for High Frequency Differential Lines Crosstalk Reduction", *IEEE Transactions on Components and Packaging Technologies*, vol. 30, No. 1, pp. 67-74, Mar. 2007.

Alexandros D. Margomenos, "Three Dimensional Integration and Packaging Using Silicon Micromachining", dissertation at the University of Michigan; Ann Arbor, Michigan; 2003.

* cited by examiner

THREE-DIMENSIONAL ARRAY ANTENNA ON A SUBSTRATE WITH ENHANCED BACKLOBE SUPPRESSION FOR MM-WAVE AUTOMOTIVE APPLICATIONS

BACKGROUND

1. Field

The invention relates to three-dimensional integrated automotive radars and methods of manufacturing the same. More particularly, the invention relates to a three-dimensional array antenna on a substrate with enhanced backlobe suppression for mm-wave automotive applications.

2. Background

Automotive radar systems are currently being provided in many luxury automobiles. Over the past few years, automotive radar systems have been used with intelligent cruise control systems to sense and adjust the automobile's speed depending on traffic conditions. Today, automotive radar systems are being used with active safety systems to monitor the surroundings of an automobile for collision avoidance. Current automotive radar systems are divided into long range (for adaptive cruise control and collision warning) and short range (for pre-crash, collision mitigation, parking aid, blind spot detection, etc.). Two or more separate radar systems, for example, a 24 GHz short range radar system and a 77 GHz long range radar system, which are typically each 15×15×15 centimeters in dimensions, are used to provide long and short range detection. Typically, the front-end (e.g., the antenna, the transmitter and the receiver) of an automotive radar system has an aperture area for the array antenna of 8 centimeters×11 centimeters and a thickness of 3 centimeters.

Prior art automotive radar systems have several drawbacks. For example, since multiple prior art radar systems are separately mounted on a vehicle, significant space is needed and can be wasteful. The cost for packaging, assembling, and mounting each radar system increases due to the additional number of radar systems. In order for each radar system to work properly, the materials placed on top of each radar system needs to be carefully selected so that the materials are RF transparent. The cost for multiple radar systems is further increased because multiple areas of RF transparency are needed on the front, sides, and rear of the vehicle. Thus, increasing the number of radar systems increases the packaging, assembly, mounting, and materials costs.

Therefore, a need exists in the art for a compact three-dimensional integrated array antenna for mm-wave automotive applications fabricated on low cost substrates.

SUMMARY

The invention is a multilayer antenna including a first microstrip patch positioned along a first plane, a second microstrip patch positioned along a second plane that is substantially parallel to the first plane, and a ground plane having a slot formed therein. The multilayer antenna also includes a microstrip feeding line for propagating signals through the slot in the ground plane and to the second microstrip patch and a backlobe suppression reflector for receiving some of the signals and reflecting the signals to the slot in the ground plane.

BRIEF DESCRIPTION OF THE DRAWINGS

The features, objects, and advantages of the invention will become more apparent from the detailed description set forth below when taken in conjunction with the drawings, wherein.

DETAILED DESCRIPTION

Apparatus, systems and methods that implement the embodiments of the various features of the invention will now be described with reference to the drawings. The drawings and the associated descriptions are provided to illustrate some embodiments of the invention and not to limit the scope of the invention. Throughout the drawings, reference numbers are re-used to indicate correspondence between referenced elements. For purposes of this disclosure, the term "patch" may be used synonymously with the term "antenna."

Figure 1:
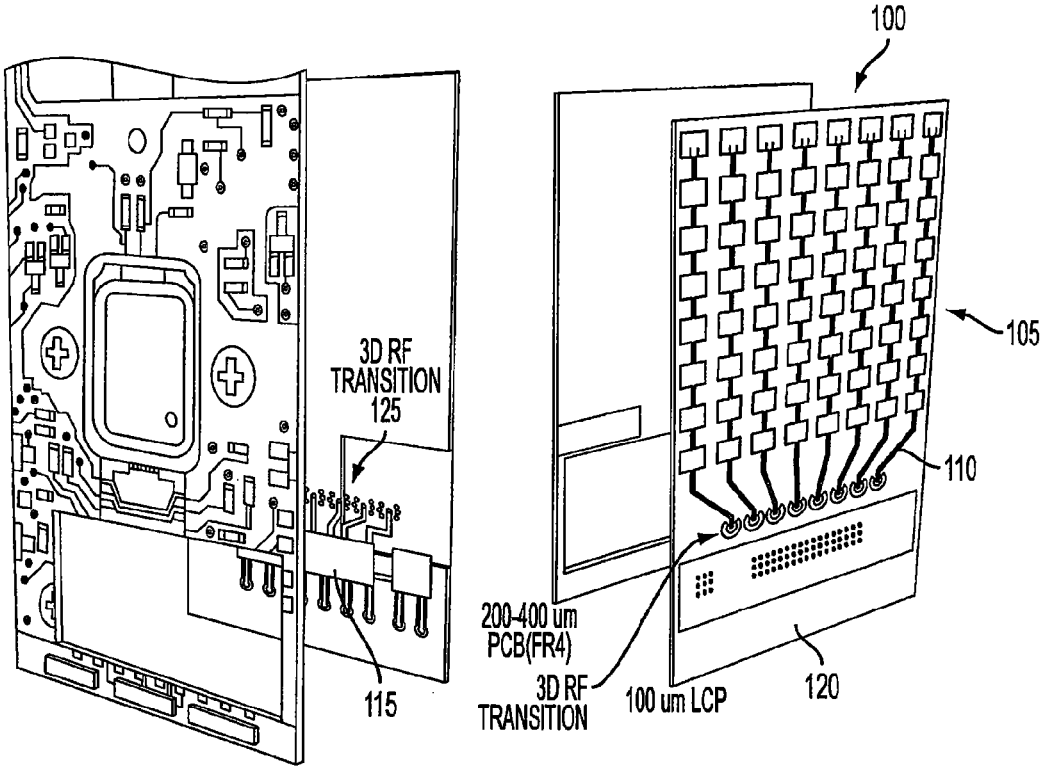
FIG. 1 is a schematic view of a prior art 3D integrated radar RF front-end system having antennas that are combined together using waveguides on a liquid crystal polymer (LCP) substrate.

FIG. 1 is a schematic view of a 3D integrated radar RF front-end system 100 having antennas 105 that are combined together using transmission lines 110 on a liquid crystal polymer (LCP) substrate 120. The antennas 105 are printed on the front-side and the transmission lines 110 are printed on the backside. The transmission lines 110 are connected to an RFIC chip 115. The transmission lines 110 provide good performance in terms of loss and low crosstalk (i.e., every channel is completely isolated from the others and extremely low levels of crosstalk are achievable). Instead of using machined metallic waveguides, the transmission lines 110 are planar lines that are printed on the LCP substrate 120. The planar lines are microstrip lines at the topside and coplanar waveguides (CPW) at the backside.

The LCP substrate 120 may be a single 100 um thick LCP layer, as shown, mounted on a 200-400 um thick, FR4 grade printed circuit board (PCB) that contains all the digital signal processing and control signals. The LCP substrate 120 has a planar phased array beam-steering antenna array 105 printed on one side. The signals from each antenna 105 are RF transitioned to the backside with a 3D vertical transition 125. In the backside, the signals converge to the RFIC chip 115.

Figure 2:
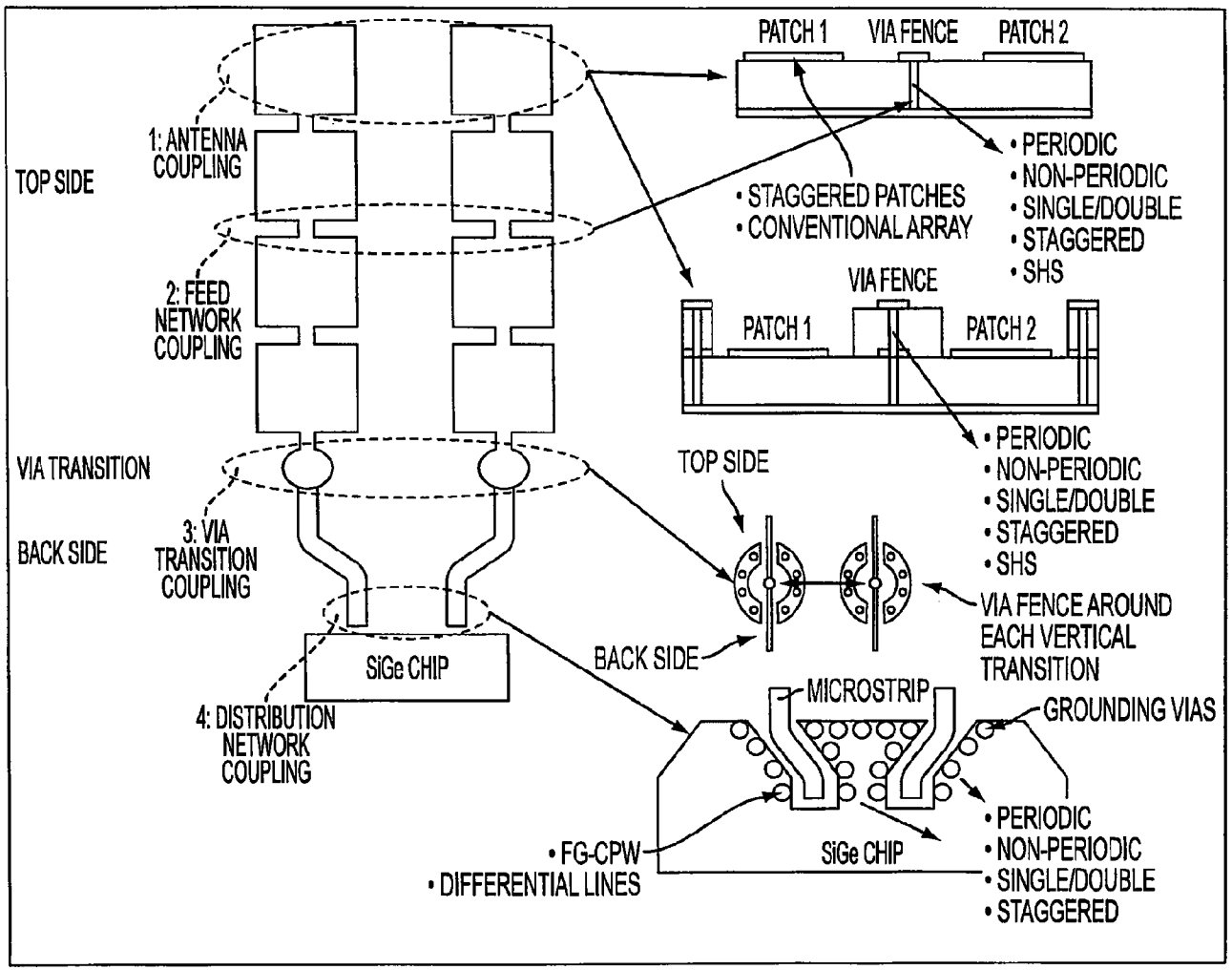
FIG. 2 is a schematic top view showing four sources of crosstalk on a three-dimensional (3D) automotive radar RF front-end according to an embodiment of the invention.

FIG. 2 shows a schematic top view on the left side of the figure with four sources of crosstalk on a three-dimensional (3D) automotive radar RF front-end according to an embodiment of the invention. The four sources of crosstalk include (1) antenna coupling, (2) feed network coupling, (3) via transition coupling and (4) distributed network coupling. A schematic side view of a portion of the 3D automotive radar RF front end corresponding to the antenna coupling and feed network coupling is shown in the top right of the figure. The two sets of microstrip patch arrays (denoted by "PATCH 1" and "PATCH 2" in FIG. 2) are printed on the top side as shown. PATCH 1 and/or PATCH 2 may have STAGGERED characteristics or arranged as an unstaggered CONVENTIONAL ARRAY as labeled in FIG. 2. The via fence positioned between PATCH 1 and PATCH 2 may have PERIODIC or NON-PERIODIC structures. The via fence may have an SHS (Soft and Hard Surface) boundary structure and may include a SINGLE row or a DOUBLE row, and the via fence may be STAGGERED or unstaggered. A schematic top view of a portion of the 3D automotive radar RF front end corresponding to the via transition coupling and distribution network coupling is shown on the bottom right of the figure. Since the 3D automotive radar RF front-end generally operates as a phased array (as opposed to a switched-beam array), the first and second sources of crosstalk are less critical to the system performance. The third source of crosstalk is limited due to the use of a via fence around each 3D transition formed in half-circle arcs around the vertical transitions as shown in the schematic view on the right side denoted by "VIA FENCE AROUND EACH VERTICAL TRANSITION." However, the fourth source of crosstalk is important due to the close proximity of the transmission lines that are close to the location of the transmit/receive SiGe chip. Hence, a large portion of crosstalk reduction can be achieved by reducing the parasitic coupling between the microstrip and the CPW transmission lines. CPW transmission lines may be FG-CPW (Finite Ground Coplanar Waveguide) transmission lines and/or the vias may be in DIFFERENTIAL LINES or pairs as shown on the bottom right of FIG. 2. The GROUNDING VIAS may be connected to a ground plane. The via fence may have PERIODIC or NON-PERIODIC structures as denoted in FIG. 2 and may include a SINGLE row or a DOUBLE row, and the via fence may be STAGGERED.

Figure 3:
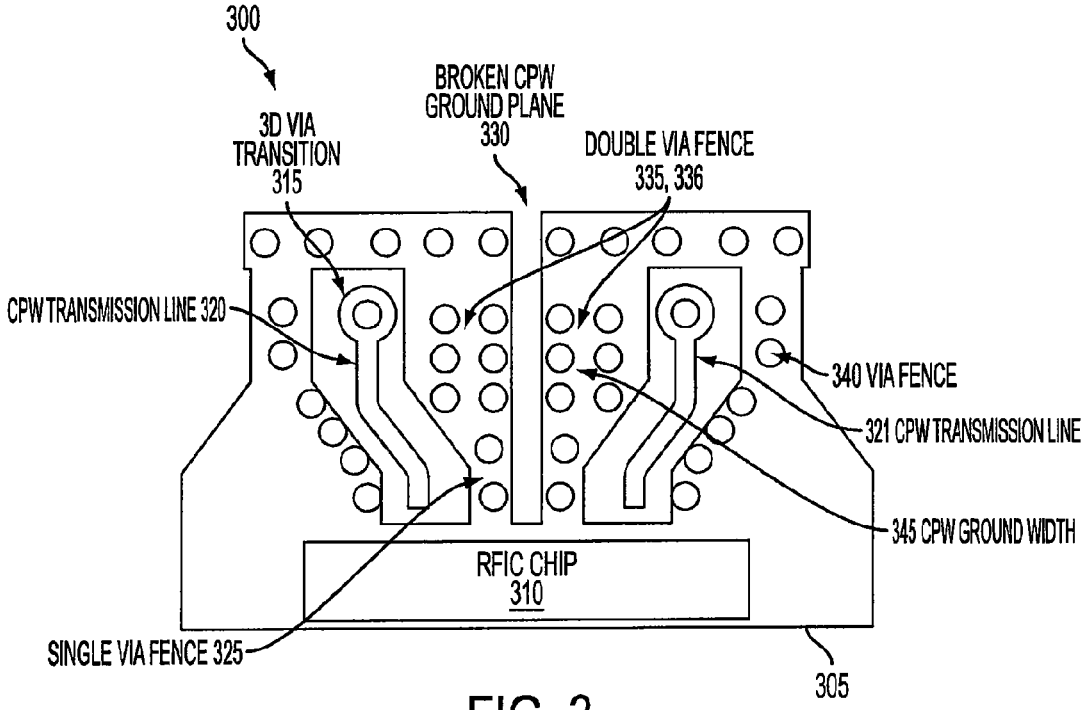
FIG. 3 is a schematic top view of a portion of a 3D automotive radar RF front-end showing the interconnection scheme between a planar beam steering antenna array on an LCP substrate and a RFIC chip according to an embodiment of the invention.

FIG. 3 is a schematic top view of a portion of a 3D automotive radar RF front-end 300 showing the interconnection scheme between a planar beam steering antenna array on an LCP substrate 305 and a RFIC chip 310 according to an embodiment of the invention. The portion of the 3D automotive radar RF front-end 300 may include a 3D via transition 315, a CPW transmission line 320, a single via fence 325, a broken CPW ground plane 330, two double via fences 335 and 336, a via fence 340, and a CPW ground width 345. The 3D automotive radar RF front-end 300 may be implemented using hardware, software, firmware, middleware, microcode, or any combination thereof. One or more elements can be rearranged and/or combined, and other radars can be used in place of the radar RF front-end 300 while still maintaining the spirit and scope of the invention. Elements may be added to the radar RF front-end 300 and removed from the radar RF front-end 300 while still maintaining the spirit and scope of the invention.

After the 3D via transition 315, the CPW transmission line 320 converges towards the RFIC chip 310. The 3D automotive radar RF front-end 300 utilizes one or more vias (e.g., the single via fence 325) that are connected to a ground plane to isolate each CPW transmission line 320 from an adjacent or neighboring CPW transmission line 320. The double via fences 335 and 336 (i.e., two vias side-by-side) allows for better isolation between CPW transmission lines 320 and 321. Each double via fence is positioned on one side of the CPW ground plane 330. A double via means there are two vias positioned side-by-side. As the CPW transmission lines 320 and 321 converge towards the RFIC chip 310, the single via fence 325 may be utilized due to size restrictions. The RFIC chip 310 is connected to the CPW transmission lines 320 and 321.

The CPW ground plane 330 is broken to reduce crosstalk between the two CPW transmission lines 320 and 321. The reason for breaking or splitting the common CPW ground plane 330 is because surface waves that are created within the LCP substrate 305 can more easily propagate and parasitically couple to the adjacent CPW transmission lines 320 and 321. Also, the CPW ground plane 330 achieve high isolation between the CPW transmission lines 320 and 321.

Figure 4:
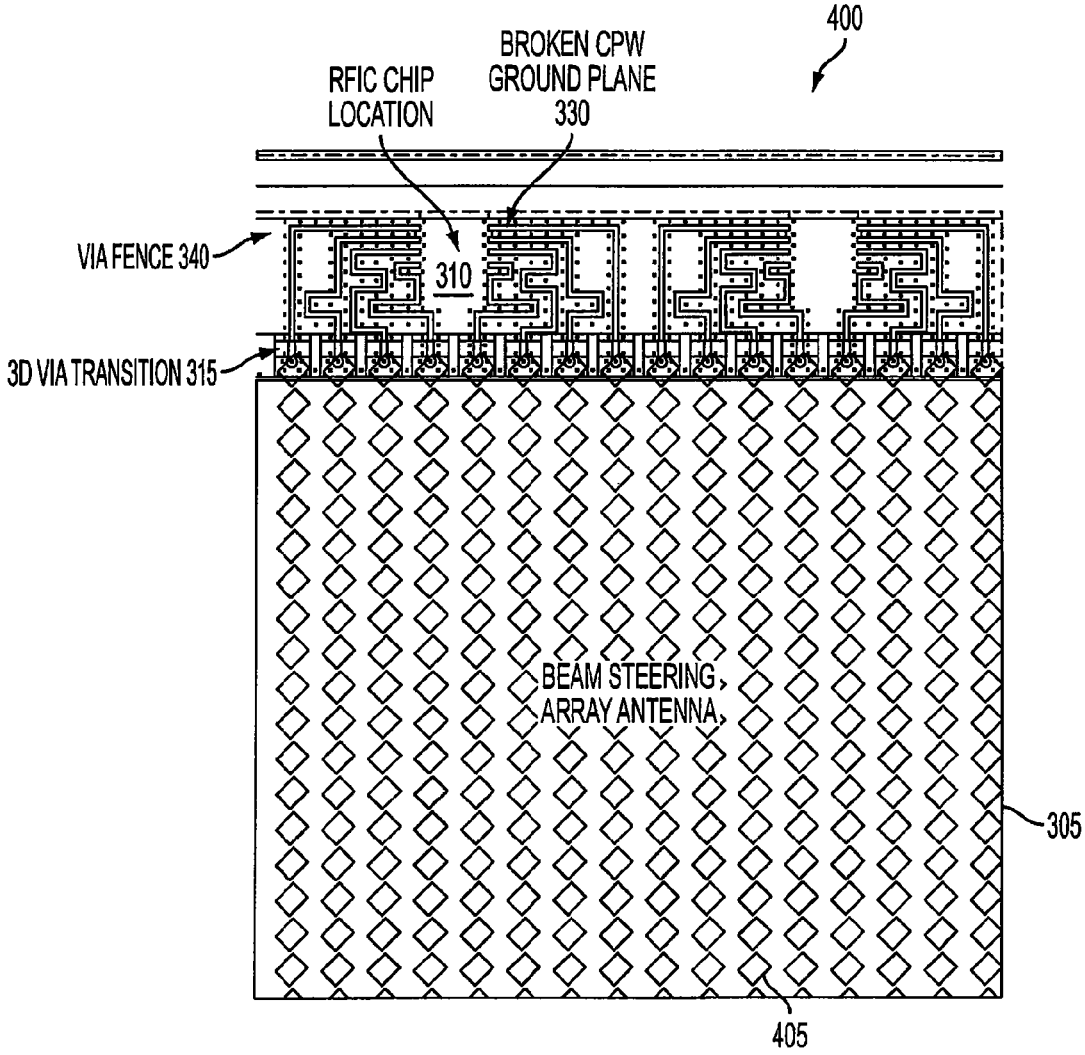
FIG. 4 is a schematic top view of a portion of a 3D automotive radar RF front-end showing how the interconnection scheme between the planar beam steering antenna array on an LCP substrate, the RFIC chip and the 3D via transition combine to form the 3D automotive radar RF front-end according to an embodiment of the invention.

FIG. 4 is a schematic top view of a portion of a 3D automotive radar RF front-end 400 showing how the interconnection scheme between the planar beam steering antenna array 405 on an LCP substrate 305, the RFIC chip 310 and the 3D via transition 315 combine to form the 3D automotive radar RF front-end 400 according to an embodiment of the invention.

Figure 5:
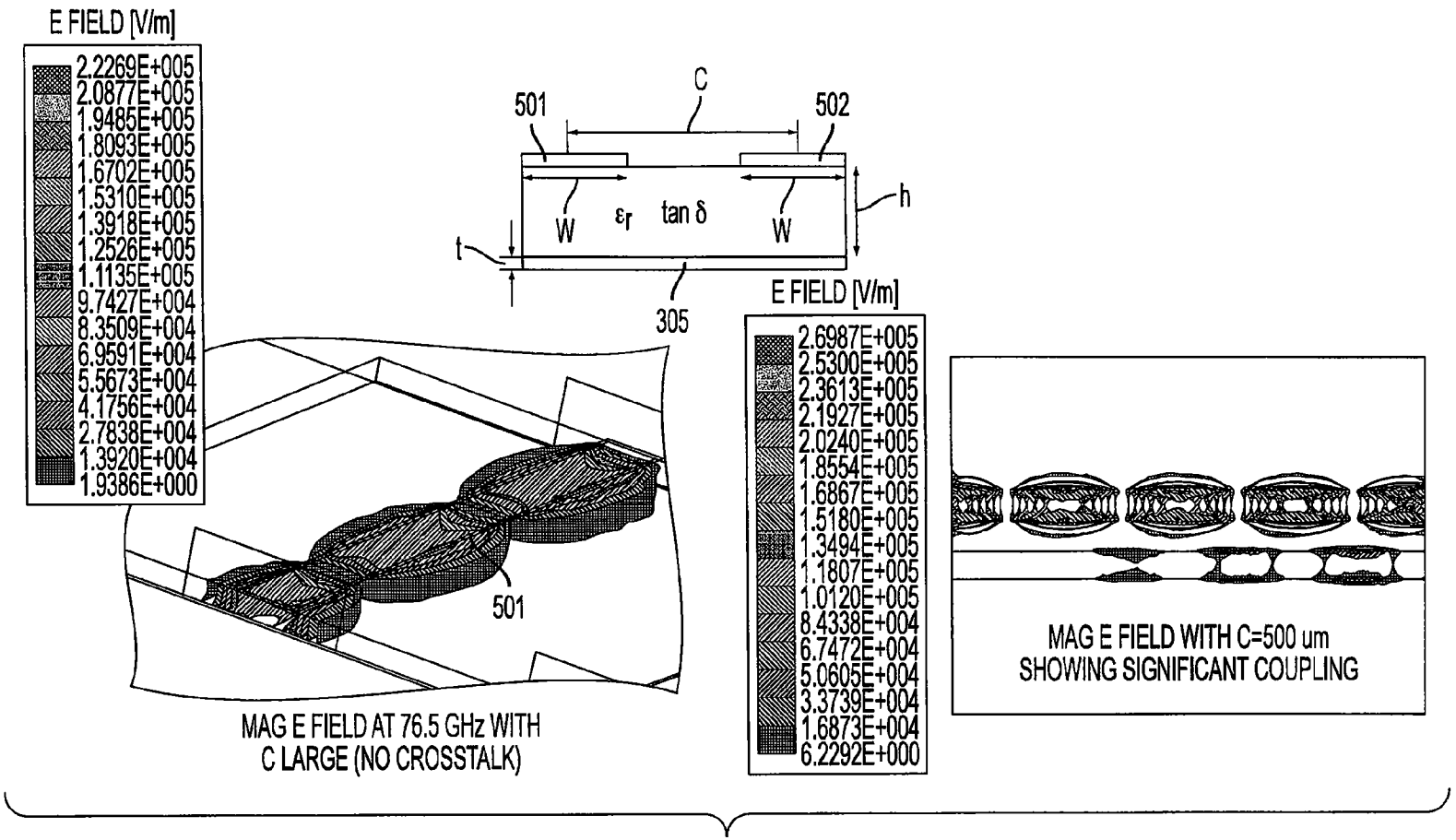
FIG. 5 includes schematic diagrams showing crosstalk between microstrip lines according to an embodiment of the invention.

FIG. 5 includes schematic diagrams showing crosstalk between microstrip lines 501 and 502 according to an embodiment of the invention. Each microstrip line 501 and 502 has a width W and a metal thickness t. Each microstrip line 501 and 502 is printed on the LCP substrate 305 (e.g., with $\epsilon_r$, tan δ, thickness h). The center-to-center lateral separation between the two adjacent microstrips 501 and 502 is C, which is about 500 μm. The lower left drawing shows the various magnitudes of electric field values at 76.5 GHz, labeled in the drawing as "MAG E FIELD AT 76.5 GHz WITH C LARGE (NO CROSSTALK)" which correspond to the magnitude of electric field values listed as "E FIELD [V/m]" in the table to the left when no coupled microstrip line is present. The lower right drawing shows the various magnitude of electric field values (labeled in the drawing as "MAG E FIELD WITH C=500 μm SHOWING SIGNIFICANT COUPLING" which correspond to the magnitude of electric field values listed as "E FIELD [V/m]" in the table to the right when the second microstrip line 502 is present at a distance C away from the first microstrip line 501.

Figure 6:
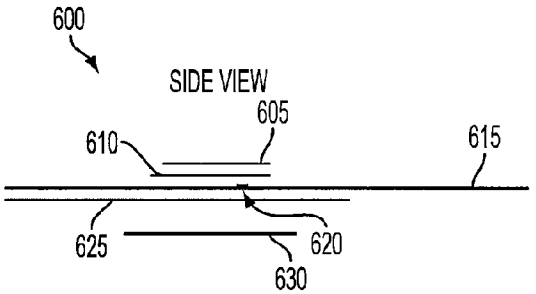
FIGS. 6, 7, and 8 are side, top perspective, and bottom perspective views, respectively, of a multilayer antenna array having two microstrip patches, a ground plane, an opening or slot in the ground plane, a microstrip feeding line, and a backlobe suppression reflector for a 3-D integrated architecture according to an embodiment of the invention.
Figure 7:
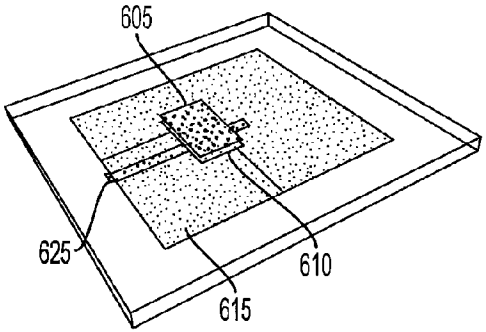
Figure 8:
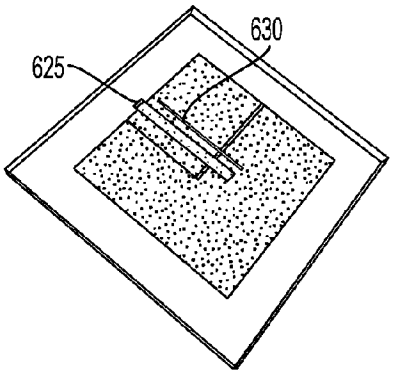

FIGS. 6, 7, and 8 are side, top perspective, and bottom perspective views, respectively, of a multilayer antenna 600 having two microstrip patches 605 and 610, a ground plane 615, an opening or slot 620 in the ground plane 615, a microstrip feeding line 625, and a backlobe suppression reflector 630 for a 3-D integrated architecture according to an embodiment of the invention. In one embodiment, the two microstrip patches 605 and 610, the ground plane 615, the microstrip feeding line 625, and the backlobe suppression reflector 630 are all spaced apart from one another and are all positioned on different parallel planes from one another. The first microstrip patch 605 may be referred to as the stacked patch 605 and the second microstrip patch 610 may be referred to as the main radiating patch 610. The first microstrip patch 605 may be positioned along a first plane and the second microstrip patch 610 may be positioned along a second plane that is substantially parallel to the first plane. In one embodiment, the opening or slot 620 is formed by an etching process. The patches shown in FIGS. 1, 2, and 3 can be configured to be similar to the patches shown in FIGS. 6, 7, and 8. The multilayer antenna 600 achieves a wider bandwidth of operation, a higher gain, and a lower backside radiation when compared to prior art antennas.

The microstrip feeding line 625 propagates signals through the opening 620 in the ground plane 615 to the main radiating patch 610, which is used to transmit the signals. The stacked patch 605 is used to direct the beams of the main radiating patch 610. In one embodiment, the two microstrip patches 605 and 610 are slot fed through the opening 620 in the ground plane 615, as opposed to a direct connection, resulting in a wider or larger bandwidth. The stacked patch 605 is positioned above or on top of the main radiating patch 610 to improve the gain and the bandwidth of the multilayer antenna array 600. In one embodiment, the stacked patch 605 is a planar version of a Yagi-Uda antenna such that the stacked patch 605 acts as a director. In one embodiment, the stacked patch 605 is attached or tacked to the main radiation patch 610.

The backlobe suppression reflector 630 is positioned below the microstrip feeding line 625 and the opening 620 in the ground plane 615. The backlobe suppression reflector 630 is designed as a resonating dipole and acts as a secondary reflector, which couples the energy that is transmitted on the backside of the antenna 600 and retransmits the energy to the front side of the antenna 600. The length of the backlobe suppression reflector 630 is approximately half a wavelength at the resonant frequency. The distance D between the main radiating patch 610 and the backlobe suppression reflector 630 has a value such that the re-transmitted energy is 180 degrees out-of-phase with the backside radiation and can therefore cancel it. The backlobe suppression reflector 630 improves the front-to-back ratio (i.e., how much energy is wasted by being transmitted to the back instead of the front) of the antenna 600 and significantly improves the aperture efficiency. The is, the aperture efficiency is improved by 60% in that the overall aperture area is reduced to a size of 5.5 cm×5.5 cm or 6 cm×6 cm. The reduced aperture area results in reduced materials and packaging and assembly costs. The backlobe suppression reflector 630 is also used to reduce or suppress radiation created by the two microstrip patches 605 and 610.

Figure 9A:
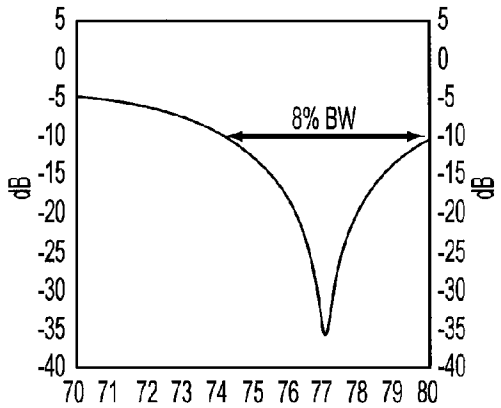
FIGS. 9A, 9B, and 9C show simulation graphs illustrating the improved performance of the multilayer antenna according to an embodiment of the invention.
Figure 9B:
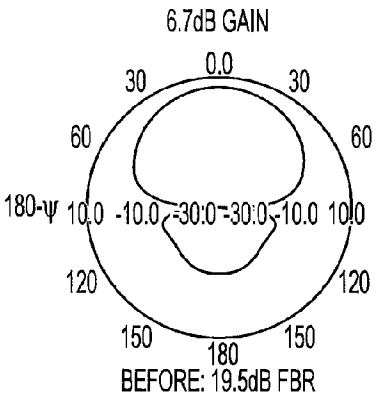
Figure 9C:
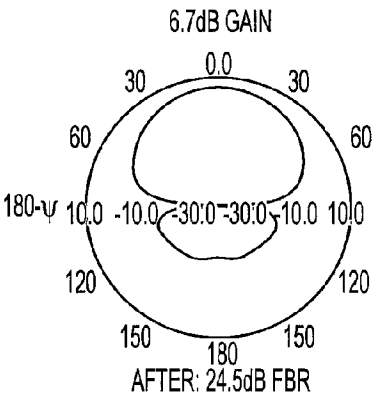

FIGS. 9A, 9B, and 9C show simulation graphs illustrating the improved performance of the multilayer antenna 600 according to an embodiment of the invention. The multilayer antenna 600 yields an 8% bandwidth, which is more than the 5% required for 77 GHz-81 GHz wideband automotive radars. The multilayer antenna 600 also yields a 6.7 dB gain and a 24.5 dB front-to-back ratio.

Figure 10:
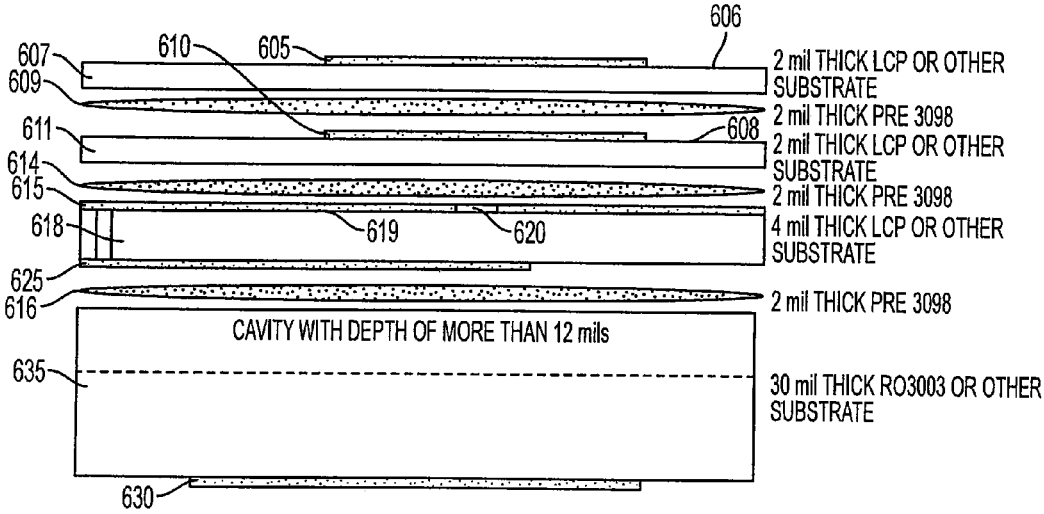
FIG. 10 shows the layers of the antenna of FIG. 6 according to an embodiment of the invention.

FIG. 10 shows the layers of the antenna 600 of FIG. 6 according to an embodiment of the invention. The antenna 600 may include substrates 607, 611, 618, and 635 (e.g., LCP) and adhesive materials 609, 614, and 616 (e.g., Pre 3098). As an example, the LCP and the Pre 3098 may be products manufactured by Rogers Corporation located in Rogers, Connecticut. The substrates 607, 611, 618, and 635 exhibit low loss at high frequencies, can be laminated with a copper material, can be stacked in multiple layers, and maintain good performance at wide temperature ranges (e.g., −40 degrees C. to +125 degrees C.).

The microstrip patch 605 is attached to or formed on a top surface 606 of the substrate 607. In one embodiment, the substrate 607 has a thickness of 2 mils. The microstrip patch 610 is attached to or formed on a top surface 608 of the substrate 611. In one embodiment, the substrate 611 has a thickness of 2 mils. An adhesive material 609 is placed between the substrate 607 and the substrate 611. In one embodiment, the adhesive material 609 has a thickness of 2 mils.

The ground plane 615 is attached or formed on a top surface 619 of the substrate 618. In one embodiment, the substrate 618 has a thickness of 4 mils. An adhesive material 614 is placed between the substrate 611 and the substrate 618. In one embodiment, the adhesive material 614 has a thickness of 2 mils. The microstrip feeding line 625 is attached or formed on a bottom surface of the substrate 618.

In one embodiment, the substrate 635 has a thickness of 30 mils. In one embodiment, the substrate 635 has an air cavity 636 of at least 12 mils (see also FIG. 11C). The microstrip feeding line 625 fits into the air cavity 636 and is attached to the substrate 635. An adhesive material 616 is placed between the substrate 618 and the substrate 635. In one embodiment, the adhesive material 616 has a thickness of 2 mils. The backlobe suppression reflector 630 is attached to or formed on a bottom surface of the substrate 635. The air cavity 636 reduces the losses of the microstrip feeding line 625 in order to achieve high antenna efficiency. Also, the air cavity 636 helps in suppressing substrate or surface modes that may otherwise be generated in the substrate 635.

Figure 11A:
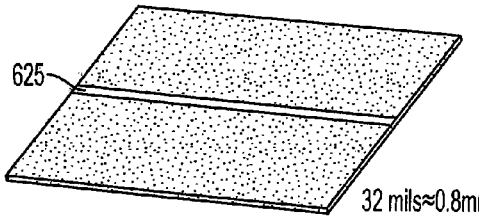
FIG. 11A is a perspective view of the microstrip feeding line embedded into a 0.4 mm LCP substrate according to an embodiment of the invention.
Figure 11B:
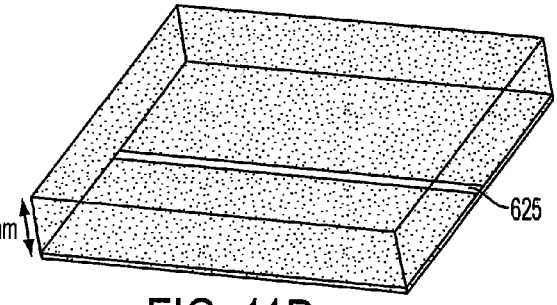
FIG. 11B is a perspective view of the microstrip feeding line embedded into a 0.8 mm LCP substrate according to an embodiment of the invention.
Figure 11C:
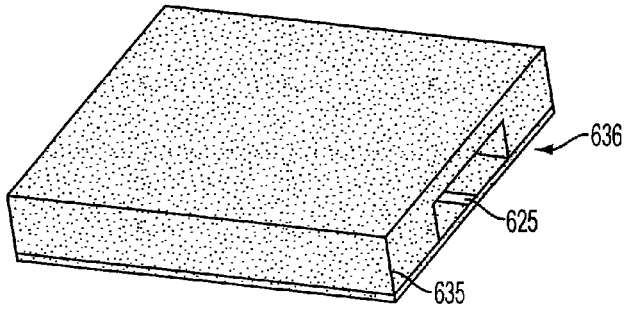
FIG. 11C is a perspective view of the microstrip feeding line positioned within the cavity of the substrate according to an embodiment of the invention.

FIG. 11A is a perspective view of the microstrip feeding line 625 embedded into a 0.4 mm LCP substrate according to an embodiment of the invention. FIG. 11B is a perspective view of the microstrip feeding line 625 embedded into a 0.8 mm LCP substrate according to an embodiment of the invention. FIG. 11C is a perspective view of the microstrip feeding line 625 positioned within the cavity 636 of the substrate 635 according to an embodiment of the invention.

Figure 12:
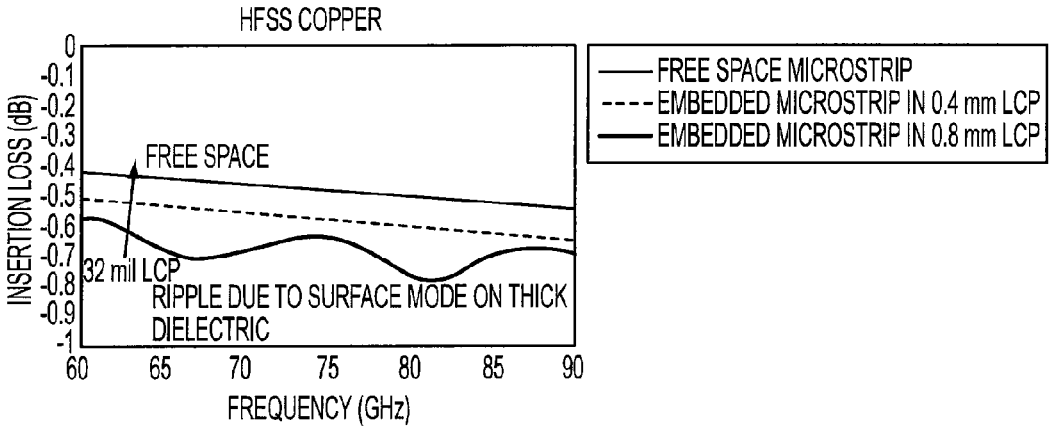
FIG. 12 is a graph showing the insertion losses of the microstrip feeding line when the microstrip feeding line is embedded in the 0.4 mm and the 0.8 mm thick LCP substrate of FIGS. 11A and 11B and is in free space as shown in FIG. 11C according to an embodiment of the invention.

FIG. 12 is a graph showing the insertion losses of the microstrip feeding line 625 when the microstrip feeding line 625 is embedded in the 0.4 mm and the 0.8 mm thick LCP substrate of FIGS. 11A and 11B and is in free space as shown in FIG. 11C according to an embodiment of the invention. The addition of the substrate 618 over the microstrip feeding line 625 increases the losses of the microstrip feeding line 625. Furthermore, when the microstrip feeding line 625 is embedded in the 0.8 mm thick LCP substrate, a ripple as shown in FIG. 12 is created on the simulated response. The ripple is due to surface wave modes that propagate in the structure because of the thickness of the substrate 635.

Figure 13:
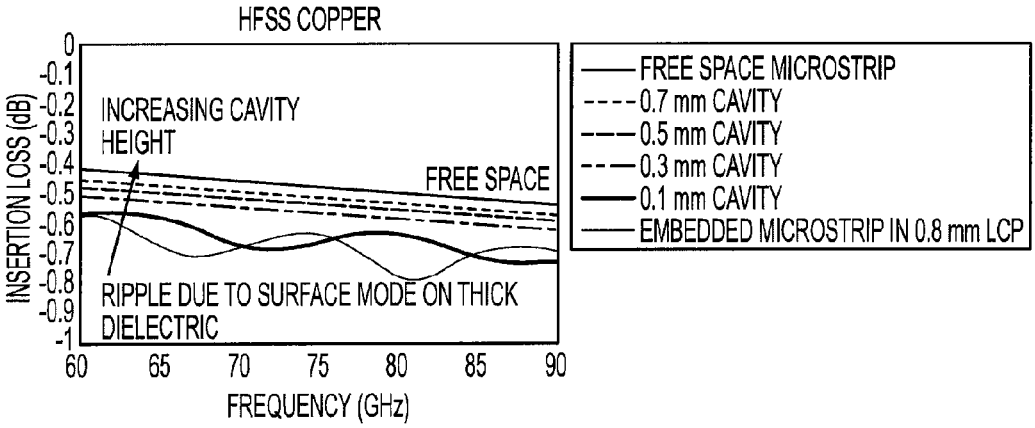
FIG. 13 is a graph showing the reduction in the losses of the microstrip feeding line and the reduction of substrate or surface modes when the air cavity is formed in different sizes in the substrate according to an embodiment of the invention.

FIG. 13 is a graph showing the reduction in the losses of the microstrip feeding line 625 and the reduction of substrate or surface modes when the air cavity 636 is formed in different sizes in the substrate according to an embodiment of the invention. As shown, the air cavity 636 may have a height of between 0.3 mm and 0.7 mm. The air cavity 636 is implemented in the substrate 635 to reduce the losses of the microstrip feeding line 625 and the substrate or surface modes. In one embodiment, the air cavity 636 has a height of at least 0.3 mm.

Figure 14:
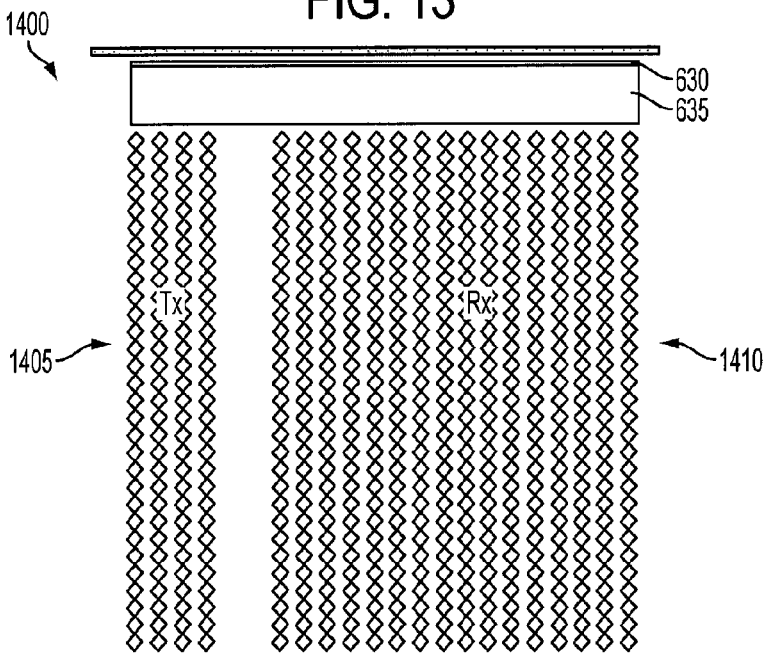
FIG. 14 shows an antenna array having a transmit antenna (Tx) and a receive antenna (Rx) according to an embodiment of the invention.

FIG. 14 shows an antenna array 1400 having a transmit antenna (Tx) 1405 and a receive antenna (Rx) 1410 according to an embodiment of the invention. In one embodiment, the transmit antenna has 4 rows of 30 antenna elements each and the receive antenna has 16 rows of 30 antenna elements each.

Those of ordinary skill would appreciate that the various illustrative logical blocks, modules, and algorithm steps described in connection with the examples disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the disclosed apparatus and methods.

The various illustrative logical blocks, modules, and circuits described in connection with the examples disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the examples disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an Application Specific Integrated Circuit (ASIC). The ASIC may reside in a wireless modem. In the alternative, the processor and the storage medium may reside as discrete components in the wireless modem.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A multilayer antenna array comprising:

a substrate;

a plurality of rows of receive antenna elements positioned on the substrate; and a plurality of rows of transmit antenna elements positioned on the substrate and spaced apart from the plurality of rows of receive antenna elements, each of the plurality of rows of receive antenna elements and each of the plurality of rows of transmit antenna elements comprise:

a first microstrip patch positioned along a first plane;

a second microstrip patch positioned along a second plane that is substantially parallel to the first plane;

a ground plane having a slot formed therein;

a microstrip feeding line positioned within a cavity defined in the substrate for propagating signals through the slot in the ground plane and to the second microstrip patch; and a backlobe suppression reflector for receiving some of the signals and reflecting the signals to the slot in the ground plane.

2. The multilayer antenna array of claim 1 wherein the cavity has a height that is between 0.3 mm and 0.7 mm.

3. The multilayer antenna array of claim 1 wherein the substrate has a thickness of at least 30 mils and is made of a liquid crystal polymer material.

4. The multilayer antenna array of claim 1 wherein the first microstrip patch is used to direct beams from the second microstrip patch.

5. The multilayer antenna array of claim 1 wherein the backlobe suppression reflector is positioned below the microstrip feeding line.

6. The multilayer antenna array of claim 1 wherein the backlobe suppression reflector absorbs radiation from the first and second microstrip patches.

7. The multilayer antenna array of claim 1 wherein the second microstrip patch is spaced apart from the backlobe suppression reflector by a distance D, where D has a value such that the reflected signals are approximately 180 degrees out-of-phase with the signals transmitted from the microstrip feeding line in order to provide cancellation of the signals.

8. The multilayer antenna array of claim 1 wherein the backlobe suppression reflector is designed as a resonating dipole.

9. The multilayer antenna array of claim 1 wherein the backlobe suppression reflector has a length that is approximately half a wavelength at a resonating frequency of the microstrip feeding line.

* * * * *